US009759535B2

(12) United States Patent
Citro et al.

(10) Patent No.: US 9,759,535 B2
(45) Date of Patent: Sep. 12, 2017

(54) GUN LAUNCHED MUNITION WITH STRAKES

(71) Applicant: BAE Systems Land & Armaments L.P., Arlington, VA (US)

(72) Inventors: Robert W. Citro, Centerville, MN (US); Paul M. O'Brien, Champlin, MN (US); Patrick J. Janke, Ramsey, MN (US); Conlee O. Quortrup, Fort Worth, TX (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 14/700,889

(22) Filed: Apr. 30, 2015

(65) Prior Publication Data

US 2015/0330755 A1 Nov. 19, 2015

Related U.S. Application Data

(60) Provisional application No. 61/986,525, filed on Apr. 30, 2014.

(51) Int. Cl.
*F42B 14/06* (2006.01)
*F42B 10/14* (2006.01)

(52) U.S. Cl.
CPC ..... *F42B 14/06* (2013.01); *F42B 10/14* (2013.01)

(58) Field of Classification Search
CPC ..... F42B 10/06; F42B 10/26; F42B 10/02; F42B 10/14; F42B 10/16; F42B 10/60; F42B 10/64; F42B 15/01
USPC ..... 102/517, 519, 520, 501; 89/1.8, 1.816, 89/1.819; 244/3.21, 3.24, 3.27, 3.29
See application file for complete search history.

(56) References Cited

U.S. PATENT DOCUMENTS 3,103,886 A * 9/1963 Popenoe ..... F42B 10/16 244/3.29
3,177,809 A * 4/1965 Russell-French ..... F42B 10/16 102/430
3,687,079 A * 8/1972 Scollins ..... F42B 14/02 102/373
4,326,464 A 4/1982 Price
(Continued)

FOREIGN PATENT DOCUMENTS

WO WO 2014197046 A2 * 12/2014 ..... F42B 10/16

OTHER PUBLICATIONS

International Search Report and Written Opinion from PCT Application PCT/US2015/028592, dated Nov. 27, 2015, 12 pgs.
(Continued)

*Primary Examiner* — Benjamin P Lee
(74) *Attorney, Agent, or Firm* — Patterson Thuente Pedersen, P.A.

(57) ABSTRACT

A projectile that includes strakes mounted about the perimeter of the midsection of the projectile and a pusher plate assembly mounted about the aft of the projectile so that a sub-caliber projectile may be fired from a larger caliber gun. The pusher plate assembly forms a seal with the bore at the aft end of the projectile. The strakes maintain the center line position of the projectile within the bore. The pusher plate assembly further designed to fragment upon exiting the bore while the strakes remain with the projectile to enhance aerodynamic qualities of the projectile in flight.

22 Claims, 4 Drawing Sheets

(56) References Cited

U.S. PATENT DOCUMENTS 4,546,940 A * 10/1985 Andersson ..... F42B 10/26 244/3.1
4,765,248 A * 8/1988 Kruse ..... F42B 10/48 102/529
4,827,847 A * 5/1989 Laviolette ..... F42B 10/54 102/501
4,838,502 A * 6/1989 Pinson ..... F42B 10/42 244/130
4,936,219 A * 6/1990 Mudd ..... F42B 15/34 102/520
5,259,321 A 11/1993 Pahnke
5,439,188 A * 8/1995 Depew, Jr. ..... F42B 10/64 244/3.21
5,461,982 A * 10/1995 Boyer, III ..... F42B 12/40 102/473
6,126,109 A * 10/2000 Barson ..... F42B 10/54 244/3.28
6,234,082 B1 5/2001 Cros et al.
6,336,609 B1 * 1/2002 Johnsson ..... F42B 10/16 102/490
6,352,218 B1 * 3/2002 Holmqvist ..... F42B 10/40 102/490
6,435,097 B1 * 8/2002 Garner ..... F42B 10/16 102/490
6,571,715 B1 * 6/2003 Bennett ..... F42B 10/38 102/374
6,685,143 B1 * 2/2004 Prince ..... B64C 5/12 244/203
6,745,978 B1 * 6/2004 Menna ..... F42B 10/14 102/377
6,783,095 B1 * 8/2004 King ..... F42B 10/14 102/377
6,869,044 B2 * 3/2005 Geswender ..... F42B 10/06 244/3.1
7,104,497 B2 * 9/2006 Johnsson ..... F42B 10/16 244/3.29
7,849,800 B2 * 12/2010 Hinsdale ..... F42B 10/14 102/473
7,935,208 B2 5/2011 Park et al.
7,997,205 B2 * 8/2011 Greenwood ..... F42B 10/38 102/490
8,071,928 B2 * 12/2011 Geswender ..... F42B 10/16 244/3.29
8,499,694 B2 * 8/2013 Bittle ..... F42B 6/003 102/501
8,919,256 B1 * 12/2014 Geswender ..... F42B 14/02 102/526
8,939,084 B2 * 1/2015 Cesaroni ..... F42B 15/22 102/399
9,021,961 B1 * 5/2015 Manole ..... F42B 10/44 102/439
9,086,258 B1 * 7/2015 Vasudevan ..... F42B 15/01
2003/0071166 A1 * 4/2003 Moore ..... F42B 10/14 244/3.28
2003/0146342 A1 * 8/2003 Hellman ..... F42B 10/40 244/3.27
2004/0011919 A1 * 1/2004 Johnsson ..... F42B 10/16 244/3.29
2004/0011920 A1 * 1/2004 Johnsson ..... F42B 10/14 244/3.29
2004/0021034 A1 * 2/2004 Hellman ..... F42B 10/14 244/3.28
2004/0094661 A1 * 5/2004 Johnsson ..... F42B 10/16 244/3.27
2009/0090809 A1 * 4/2009 Ronn ..... F42B 10/14 244/3.28
2010/0314489 A1 * 12/2010 Buckland ..... F42B 10/64 244/3.27
2012/0048991 A1 * 3/2012 Frey, Jr. ..... F42B 10/06 244/3.15
2012/0068002 A1 * 3/2012 Unger ..... F42B 10/64 244/3.28
2013/0319212 A1 12/2013 Hunter et al.

OTHER PUBLICATIONS

International Preliminary Report on Patentability from PCT Application PCT/US2015/028592, dated Nov. 10, 2016, 9 pgs.

* cited by examiner

GUN LAUNCHED MUNITION WITH STRAKES

RELATED APPLICATION

The present application claims the benefit of U.S. Provisional Application No. 61/986,525 entitled GUN LAUNCHED MUNITION WITH STRAKES, filed Apr. 30, 2014, which is incorporated herein by reference in its entirety.

FIELD OF THE INVENTION

The present invention is a unique way to allow a smaller diameter projectile to be fired from a gun with a larger bore. More specifically, the present invention involves adding boreriding strakes and a pusher plate to existing gun launched projectiles.

BACKGROUND OF THE INVENTION

It is well known to design projectiles having a smaller caliber encased in a larger caliber sabot. The projectile must fit tightly within the barrel to maximize the efficiency of the propellant charge. Gaps about the projectile allow for the propellant force to escape so the sabot must make up the space between the barrel and the small caliber projectile. The sabot then transfers the propellant driving force to the smaller projectile. The sabot typically breaks into pieces after leaving the muzzle of the gun. In this way a larger caliber gun can have increased performance and the ability to perform multiple missions.

Previous approaches to launching smaller diameter munitions from a gun with a larger bore include utilizing full size sabots to build up the diameter of the projectile to the larger gun bore diameter. A sabot is typically formed from 2 or more petals. The petals surround the smaller projectile. The petals are heavy, and fly a long, unpredictable distance from the bore of the gun, creating a large Surface Danger Zone (SDZ) in front of the gun. An impact by a sabot petal may cause serious injury or death.

Split sabots are another alternate approach to placing a smaller diameter projectile into a larger diameter gun bore. The split sabots are generally smaller and lighter than the full length sabots. However, as with the full length sabots, the split sabots have petals that may injure personnel upon exiting the bore. In addition, the split sabots may damage the gun or the projectile if they split too early.

As the current methods create a danger zone as the petals detach, a new approach is needed that improves the safety and efficiency for smaller than bore projectiles.

SUMMARY OF THE INVENTION

The present invention is a munition for a gun, for example a 155 mm or 5 inch gun. The goal is to replace the sabots typically used with munitions with additional structure that does not create a risk of harming personnel or damaging the gun. The present invention includes adding aerodynamic strakes and a pusher plate to the munition. The strakes and the pusher plate support the projectile within the gun bore. The strakes remain affixed to the round in flight, providing aerodynamic lift. The lightweight pusher plate discards at muzzle exit, but is much less hazardous than the traditional sabot petals.

The new approach for a projectile replaces the sabots with aerodynamic strakes and a pusher plate to support the projectile within the gun bore. The strakes are disposed about the munition between the nose the tail. The location of the strakes is determined based on the type of subcaliber munition. The strakes are typically positioned symmetrically about the perimeter to balance the munition on the bore and assist aerodynamically. The strakes may remain affixed to the round in flight, providing aerodynamic lift.

The lightweight pusher plate is mounted about the tail of the projectile. The pusher plate comprises a pusher plate assembly. The pusher plate assembly is segmented and discards after muzzle brake exit. The discarding segments are located toward the aft of the tails, which minimizes risk of tail impact and damage. The pusher plate assembly serves as an in-bore gas seal. An obturator band surrounds the pusher plate assembly and helps to keep pusher plate assembly together prior to the firing, but breaks up in-bore and discards at muzzle exit. The obturator contacts the bore at the outer perimeter and traps the tail fins under the pusher plate segments in an undeployed position at its inner perimeter. The pusher plate segments may define an exterior groove for the obturator. The interior surface of the pusher plate segments may have indentations to closely fit the undeployed tail fin surfaces.

The present invention is a projectile that includes strakes mounted about the perimeter of the midsection of the projectile and a pusher plate assembly mounted about the aft of the projectile so that a sub-caliber projectile may be fired from a larger caliber gun. The pusher plate assembly forms a seal with the bore at the aft end of the projectile. The strakes maintain the center line position of the projectile within the bore. The pusher plate assembly further designed to fragment upon exiting the bore while the strakes remain with the projectile to enhance aerodynamic qualities of the projectile in flight.

The present invention is a sub-caliber projectile for use with a larger caliber gun, the sub-caliber projectile comprising: a projectile body defined by a nose, a mid-section and an aft section; a plurality of canards positioned radially about the nose section of the projectile, said canards disposed within the body of the projectile until the projectile exits the muzzle of the gun; a plurality of tail fins positioned radially about the aft section of the projectile, said tail fins being folded about the perimeter of the projectile body until the projectile exits the muzzle of the gun; a plurality of boreriding strakes, the strakes being disposed about the midsection of the projectile body; and a pusher plate assembly positioned about the aft section of the projectile, said pusher plate assembly including a plurality of petals that form a ring that restrains the tail fins and an obturator ring disposed about the petals so as to hold the petals together in a ring shape until the projectile exits the gun.

The present invention includes a method of producing a projectile having a projectile body with a caliber less than a bore diameter of a gun; the method comprising; attaching a boreriding strake to the projectile body; and disposing a pusher plate assembly about the aft end of the projectile body. The method may include wherein the strakes are attached to a sleeve which is then attached to the projectile body. The pusher plate assembly may further comprise an obturator ring.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

Figures 1A, 1B:
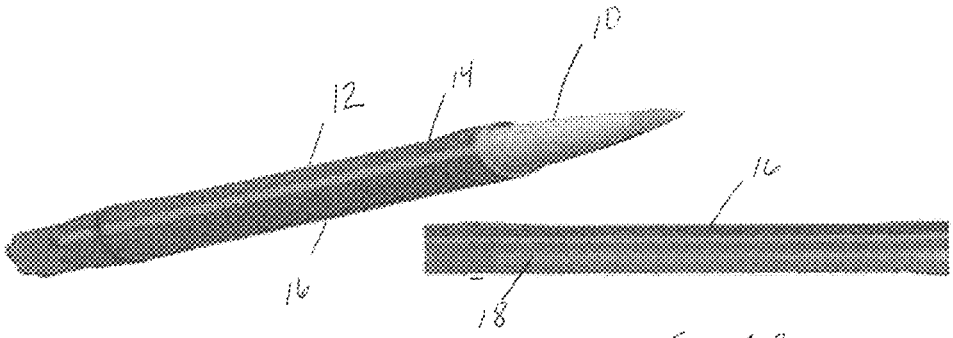
FIG. 1A FIG. 1B PRIOR ART
FIG. 1A is a perspective view of the prior art full length sabot.
FIG. 1B is a plan view of a sabot petal.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

In the present invention, sabots are replaced by, bore-riding strakes and a pusher plate. Eliminating the size and mass of the sabot minimizes soldier safety hazard due to discarding mass and greatly reduces risk of discards damaging the muzzle brake or the projectile. Moreover, smaller diameter projectiles enabled by the present invention fly farther due to lower drag. The present invention further allows efficiencies in projectile manufacture. The same projectile can now be tired from different size guns due the addition of the present invention.

The present invention differs from the prior art in that the strakes remain with the projectile during flight, reducing soldier safety hazard. Strakes provide aerodynamic lift increasing range. The pusher plate assembly is discarded after firing at which time the tail surfaces are deployed. Nose canards can then also be deployed.

FIG. 1A is a perspective view of a projectile 10 with a prior art full length sabot 12. In the prior art, the projectile 10 is almost fully encased by a sabot 12 having at least two parts 14 and 16. The sabot 12 allows a smaller diameter projectile 10 to fit within a gun bore. The sabot 12 is almost the same length as the projectile and breaks in half upon firing, thus leaving a large object flying out of the bore in an erratic flight path. FIG. 1B is a plan view of the sabot petal 16. The interior face 18 of sabot petal 16 mates with the outer perimeter of the projectile 10.

Figures 2A, 2B:
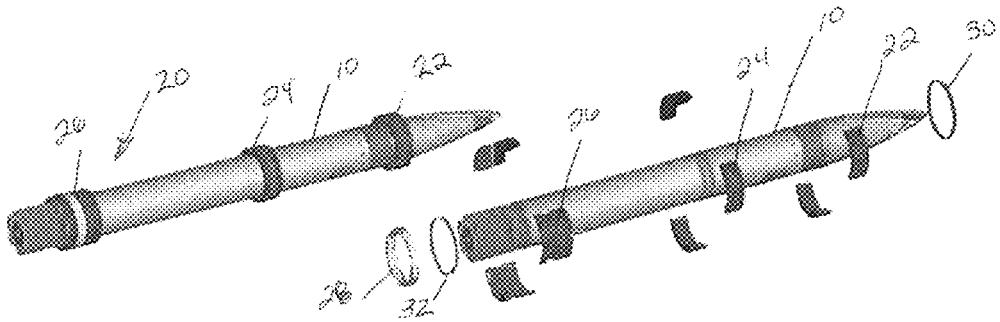
FIG. 2A FIG. 2B PRIOR ART
FIG. 2A is a perspective view of the prior art split sabot design.
FIG. 2B is an exploded view of the sabot structure about the projectile.

FIG. 2A is a perspective view of projectile 10 with the prior art split sabot 20 design. The split sabot 20 includes multiple pieces that surround the nose 22, mid body 24 and tail 26 of the projectile 10. The split sabot 20 may also include a pusher plate 28. The split sabot design 20 includes multiple obturator rings 30 and 32 that maintain the position of the projectile while firing. As illustrated in FIG. 2B, there is a forward obturator 30 and a rear obturator ring 32.

Figure 3:
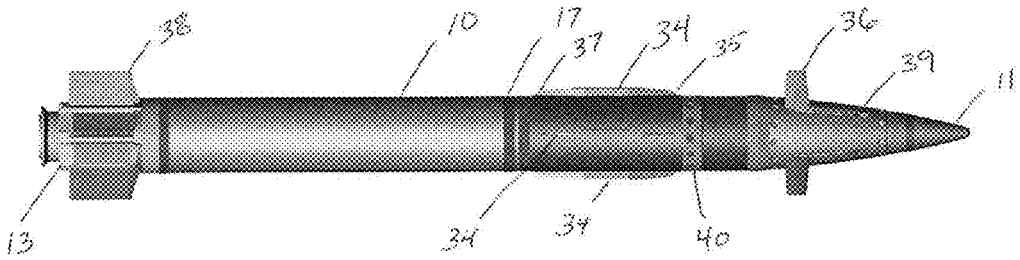
FIG. 3 is a side view of a projectile with strakes after leaving the bore of the gun.

FIG. 3 is a side view of a projectile 10 with a plurality of strakes 34 positioned mid-body. In this view, the projectile has left the barrel of the gun. The projectile 10 includes a plurality of canards 36 disposed about the nose 11 of the projectile 10. A plurality of tail fins 38 are disposed radially about the aft end 13 of the projectile 10. Note that the canards 36 and tail fins 38 are in shown in a deployed position but that they are held within the envelope of the projectile 10 when in the bore of the gun. In FIG. 3, the canards 36 are stored within canard slots 39 and the tail fin sections 38 fold along the aft body 13 of the projectile 10.

Strakes 34 are disposed approximate the midsection 17 of projectile 10. The strakes 34 may have aerodynamic leading edges 35 or may be blunt. In this embodiment, there are four strakes positioned approximately at 90 degrees about the perimeter of the projectile 10. In alternate embodiments, the strakes 34 could be positioned at 180 degrees, or every 60 degrees, or other combinations that provide for symmetric positioning. The strakes 34 have leading edge 36 and trailing edge 37 which are angled fore and aft, respectively, to be more aerodynamic. The strakes 34 may also have an arcuate shape. The strakes 34 remain with projectile 10 during flight, reducing soldier safety hazard. The strakes 34 are sized to extend from the projectile 10 to closely contact the bore of the gun thus eliminating the need for a forward obturator ring as shown in the prior split sabot design of FIG. 2A.

Figure 4:
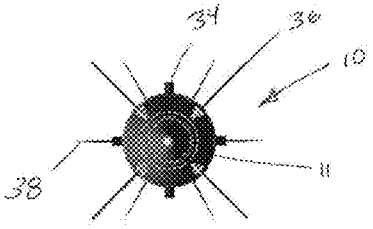
FIG. 4 is a nose on view of the projectile of FIG. 3.

FIG. 4 is a nose on view of the projectile 10 of FIG. 3. The canards 36 and the strakes 34 are offset so as to not to aerodynamically interfere with each other. The tail fins 38 may align with the strakes 30 or canards 13 or be independently aligned when viewed from the nose 11.

Figure 5:
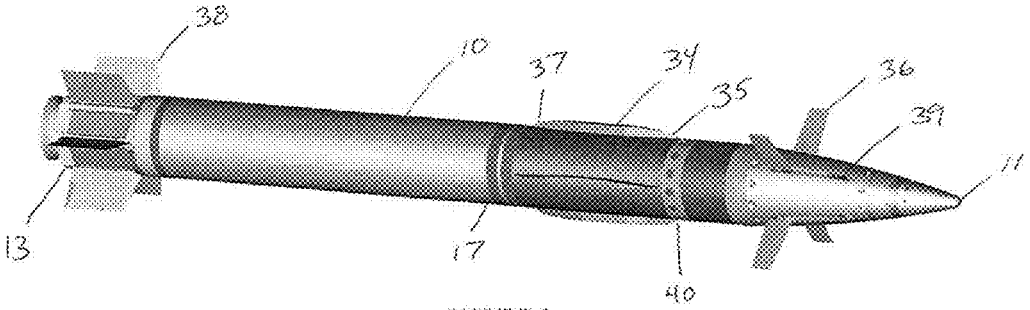
FIG. 5 is a perspective view of the projectile of FIG. 3.

FIG. 5 is a perspective view of the projectile of FIG. 3. Projectile 10 includes canards 36 disposed between the nose 11 and the strakes 34 disposed about midsection 17. The canards 36 are undeployed while in the bore but in this embodiment they are shown in the deployed position. Canards 36 are mounted evenly about the perimeter of the projectile 10 for providing guided flight. The strakes 34 are also evenly spaced about the perimeter of the projectile 10. In this embodiment, there are four strakes 34. The strakes 34 can be attached by a variety of means to the projectile 10, including welding, bolting, or any other appropriate means. Note that in this embodiment the strakes 34 and the canards 36 are staggered so that as not to overlap each other. The strakes 34 may be part of a retrofit in which they strakes 34 are added to an existing projectile 12 by attaching, for example, a collar 40 or band type of arrangement that includes the strakes 34. The tail fins 38 are shown in a deployed position.

Figure 6:
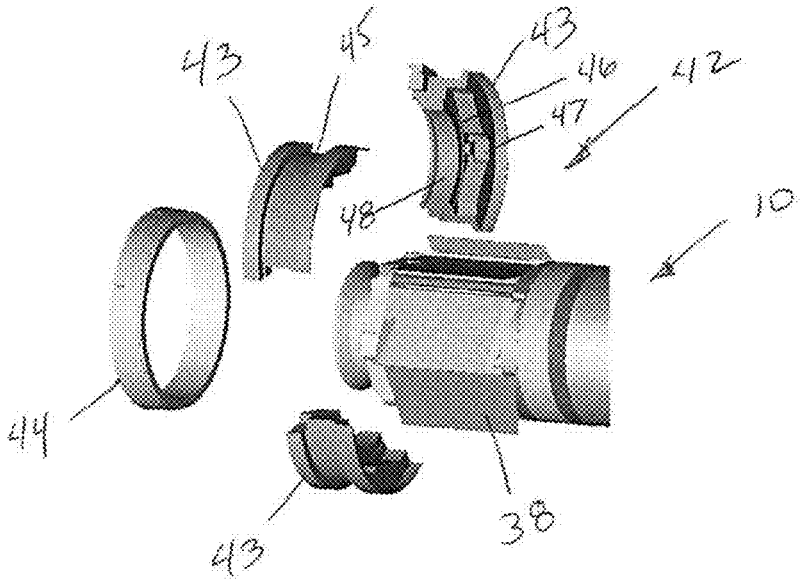
FIG. 6 is an exploded view of the pusher plate assembly.

FIG. 6 is an exploded view of the pusher plate assembly 42. The pusher plate assembly 42 is segmented in this embodiment into 3 petals 43 and discards after muzzle brake exit. The discarding parts 43 are located toward the aft 13 of the projectile 10, which minimizes risk of tail impact and damage. The pusher plate assembly 42 serves as an in-bore gas seal. An obturator 44 helps to keep pusher plate assembly 42 together prior to the shot, but breaks up in-bore and discards at muzzle exit. The obturator 44 contacts the bore at the outer perimeter and traps the tail fins under the pusher plate segments 43 in an undeployed position at its inner perimeter. The pusher plate segments 43 may define an exterior groove 45 for the obturator 44. It is envisioned that the obturator 44 has a thickness greater than the groove 45 so that the obturator 44 and not the petals 43 are in contact with bore of the gun. The interior surface 46 of the pusher plate segments 43 may have indentations 47 to closely fit the undeployed tail fin surfaces 38 and an internal ring 48 that surrounds the projectile 10 just aft of the fins 38. In this embodiment there are three petals 43 but it is envisioned that there may be 2 or more petals. Furthermore, the pusher plate assembly 42 only covers the aft end of the fins 38 but in alternative embodiments the entire fin or lesser portions may be covered.

Figure 7:
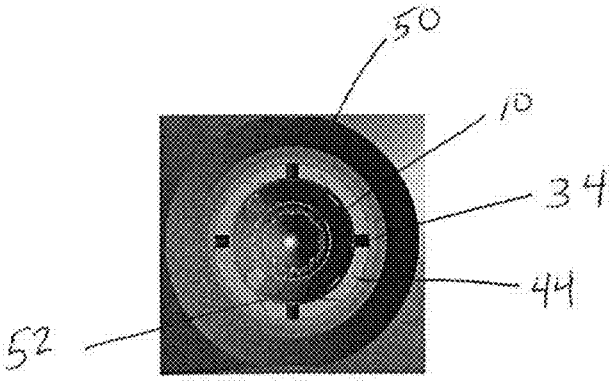
FIG. 7 is a nose on view of the projectile inside a gun bore.

FIG. 7 is a nose 11 on view of the projectile 10 inside a gun bore 50. When viewed from the muzzle end of the gun, the strakes 34 are in contact with the bore 50. The obturator band 44 of the rear pusher plate assembly 42 is also seen in contact with the bore 50. While in the bore 50, the fins 38 and canards 36 are in a stored position within the projectile 10. In this view, the fail lines 52 of the obturator band 44 are visible for allowing segmentation of the band 44 upon exit of the bore 50.

Figure 8:
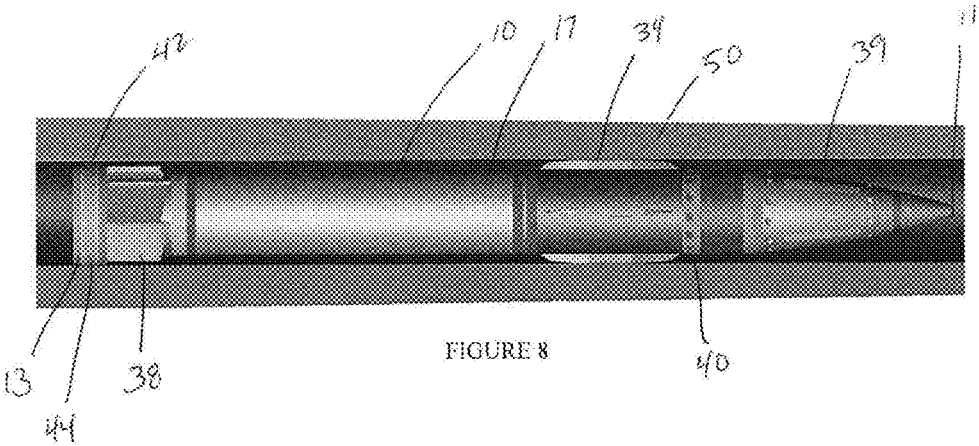
FIG. 8 is a side view of the projectile of FIG. 7 inside a gun bore.
Figure 9:
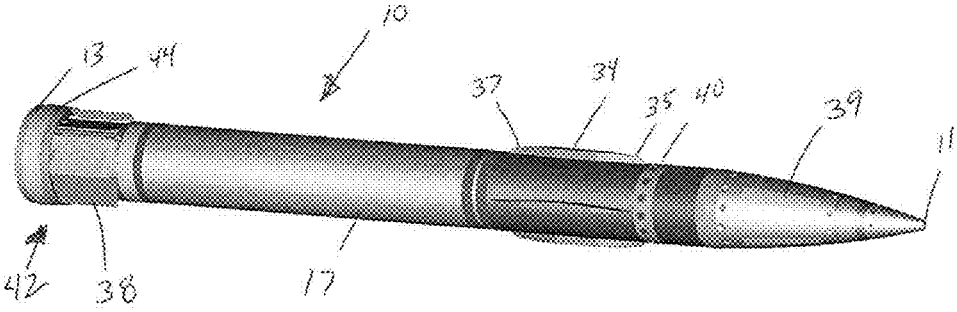
FIG. 9 is a perspective view of a projectile with pusher plate.

FIG. 8 is a side view of the projectile 10 of FIG. 7 inside a gun bore 50 and FIG. 9 is a perspective view of a projectile 10 with pusher plate 42 outside of the gun. The pusher plate 42 at least partially covers the tail fins 38. The canards 36 are flush to the nose 11 within slots 39. In FIG. 8, the strakes 34 are in contact with bore 50 so as to evenly position the projectile 10 within the center line of the bore 50. The arcuate shape of the strake 34 minimizes the strakes 34 contact with the bore 50. The obturator band 44 of the pusher plate assembly 42 is snugly in contact with bore 50 at the aft end of the projectile 10.

In operation, the projectile 10 would be fitted with the pusher plate 42 and the strakes 34 and placed in the bore 50 of a gun. The pusher plate 42 and strakes 34 could be retrofitted to a projectile 10 or installed at the time of manufacture. Upon firing, the strakes 34 would guide the projectile 10 down the bore 50 and the obturator 44 about the pusher plate assembly 42 would seal the projectile 10 to the bore 50. Once clear of the muzzle break, the pusher plate 42 and obturator 44 would separate. The pusher plate assembly 42 would divide into segments 43. The obturator 44 may also divide into segments. The tail fins 15 would then be free to deploy. The combination of tail fins 15, canards 13 and strakes 30 would improve flight characteristics of the projectile 10.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A sub-caliber projectile for use with a larger caliber gun, the sub-caliber projectile comprising:

a projectile body defined by a nose, a mid-section and an aft section;

a plurality of canards positioned radially about the nose section of the projectile, said canards disposed within the body of the projectile until the projectile exits the muzzle of the gun;

a plurality of tail fins positioned radially about the aft section of the projectile, said tail fins being folded about the perimeter of the projectile body until the projectile exits the muzzle of the gun;

a plurality of boreriding strakes, the strakes being disposed about the midsection of the projectile body, sized to extend from the projectile body so that the diameter of the projectile at the midsection combined with a height of the strake equals a bore of the larger caliber gun;

a pusher plate assembly positioned about the aft section of the projectile, said pusher plate assembly including a plurality of petals that form a ring that restrains the tail fins and an obturator ring disposed about the petals so as to hold the petals together in a ring shape until the projectile exits the gun at which point the pusher plate assembly separates from the projectile, the obturator plate forming an aft seal within the bore; and wherein the strakes and the pusher plate are spaced apart longitudinally so as to center the nose of the sub-caliber projectile in the bore.

2. The sub-caliber projectile of claim 1 wherein the strakes are symmetrically positioned at equal increments about the perimeter of the mid section of the projectile body.

3. The sub-caliber projectile of claim 2 wherein there are four strakes positioned at approximately ninety degrees about the perimeter of the projectile body.

4. The sub-caliber projectile of claim 1 wherein the strakes extend radially from the projectile body so as to be in contact with the bore of the gun.

5. The sub-caliber projectile of claim 1 wherein the strakes have an arcuate shape.

6. The sub-caliber projectile of claim 1 wherein the strakes have a leading edge and a trailing edge, wherein the leading edge and the trailing are symmetric.

7. The sub-caliber projectile of claim 1 wherein the strakes have a leading edge and a trailing edge, wherein the leading edge and the trailing are not symmetric.

8. The sub-caliber projectile of claim 1 wherein the strakes have a leading edge and a trailing edge, wherein the leading edge is rounded to provide enhanced aerodynamic qualities while the projectile is in flight.

9. The projectile according to claim 1 wherein the plurality of tail fins, when deployed, are aligned axially with the strakes.

10. The projectile according to claim 1 wherein the plurality of canards, when deployed, are axially offset from the position of the strakes.

11. The projectile according to claim 1 wherein the obturator ring is comprised of segments, allowing for break up post deployment.

12. The projectile of claim 1 wherein the petals of the pusher plate assembly define an exterior groove for placement of the obturator ring.

13. The projectile of claim 1 wherein the petals of the pusher plate assembly define an interior indentations for holding the tail fins in an undeployed position.

14. The sub-caliber projectile of claim 1 wherein the strakes are attached to a sleeve which is then attached to the projectile body.

15. A method of producing a projectile having a projectile body with a caliber less than a bore diameter of a gun; the method comprising;

attaching a plurality of boreriding strakes to the projectile body, the boreriding strakes sized to extend from the projectile body into close contact with a bore of the gun;

attaching a plurality of canards positioned radially about a nose section of the projectile, said canards disposed within the body of the projectile until the projectile exits a muzzle of the gun;

disposing a pusher plate assembly about the aft end of the projectile body; and spacing the strakes longitudinally along the projectile so that the aft pusher plate and the strakes are in contact with the bore of the gun so as to keep the projectile body centered within the bore of the gun.

16. A method of producing a projectile of claim 15 wherein the strakes are attached to a sleeve which is then attached to the projectile body.

17. The method of producing a projectile of claim 15 wherein the pusher plate assembly further comprises an obturator ring.

18. The method of producing a projectile of claim 15 wherein the strakes are sized to axially extend from the outer perimeter of the projectile body to the internal perimeter of the bore of the gun.

19. The method of producing a projectile of claim 15 wherein the pusher plate assembly is sized to extend from the outer perimeter of the projectile body to the internal perimeter of the bore of the gun.

20. The method of producing a projectile of claim 19 wherein the pusher plate assembly includes petals, said petals separating upon exiting the bore of the gun.

21. The method of producing a projectile of claim 17 wherein the obturator ring fragments upon exiting the bore of the gun.

22. The method of producing a projectile of claim 17 wherein the obturator ring forms a seal with the bore of the gun.

* * * * *